US011173385B2

(12) United States Patent
Mullenbach

(10) Patent No.: US 11,173,385 B2
(45) Date of Patent: Nov. 16, 2021

(54) TABLE GAME WITH SPINNING PIECES

(71) Applicant: Joseph Matthew Mullenbach, Chicago, IL (US)

(72) Inventor: Joseph Matthew Mullenbach, Chicago, IL (US)

(73) Assignee: Joseph Mullenbach, Chicago, IL (US)

( * ) Notice: Subject to any disclaimer, the term of this patent is extended or adjusted under 35 U.S.C. 154(b) by 0 days.

(21) Appl. No.: 16/799,828

(22) Filed: Feb. 25, 2020

(65) Prior Publication Data

US 2020/0324192 A1 Oct. 15, 2020

Related U.S. Application Data

(60) Provisional application No. 62/808,910, filed on Feb. 22, 2019.

(51) Int. Cl.

| | |
|---|---|
| ***A63F 7/40*** | (2006.01) |
| ***A63F 7/30*** | (2006.01) |
| ***A63F 7/24*** | (2006.01) |
| ***A63F 7/36*** | (2006.01) |

(52) U.S. Cl.

CPC ..... *A63F 7/40* (2013.01); *A63F 7/2436* (2013.01); *A63F 7/30* (2013.01); *A63F 2007/3005* (2013.01); *A63F 2007/3655* (2013.01); *A63F 2007/4068* (2013.01)

(58) Field of Classification Search

CPC .. A63F 7/40; A63F 7/30; A63F 7/2436; A63F 2007/4068; A63F 2007/3005; A63F 2007/3655; A63F 7/0668

See application file for complete search history.

(56) References Cited

U.S. PATENT DOCUMENTS 445,016 A * 1/1893 Greene
509,316 A * 11/1893 Lapham
566,309 A * 8/1896 Grassow ..... A63F 7/0005 273/126 R
1,619,279 A * 3/1927 Wagner ..... A63F 7/0668 273/317.3
2,900,189 A 8/1959 Howlett
3,429,573 A * 2/1969 Cederberg ..... A63D 3/00 273/108
4,017,079 A * 4/1977 Apellaniz ..... A63F 7/0023 273/126 R
4,252,324 A * 2/1981 Simons ..... A63F 3/00088 206/579
4,422,645 A * 12/1983 Simons ..... A63F 3/00088 206/315.1
4,513,964 A 4/1985 Gunderson
5,282,635 A * 2/1994 Hopkins ..... A63B 63/007 273/342
5,454,566 A * 10/1995 Koenig ..... A63F 7/0023 273/108
5,845,908 A * 12/1998 Reichardt ..... A63F 7/40 273/317
5,992,847 A * 11/1999 Beck ..... A63F 9/16 273/108.1

(Continued)

*Primary Examiner* — Michael D Dennis

(57) ABSTRACT

A table game construction and method of play in which a spinning game piece follows along a curved trajectory, which may be further directed after release, and which interacts with other game pieces through collisions. The game components include a game board, one or more propelled spinning game pieces, and an optional striking object.

9 Claims, 9 Drawing Sheets

(56) References Cited

U.S. PATENT DOCUMENTS

| | | | | |
|---|---|---|---|---|
| 6,182,965 | B1 * | 2/2001 | Escort | A63F 11/0011 273/138.1 |
| 7,121,547 | B1 * | 10/2006 | Stevens | A63F 7/0023 273/126 R |
| 2004/0227284 | A1 * | 11/2004 | Christianson | A63B 67/06 273/126 R |
| 2008/0073843 | A1 * | 3/2008 | Pfaender | A63F 7/0668 273/236 |
| 2015/0258401 | A1 * | 9/2015 | Burkman | A63B 67/06 273/409 |
| 2020/0061452 | A1 * | 2/2020 | Choi | G03B 21/14 |

* cited by examiner

TABLE GAME WITH SPINNING PIECES

1 BACKGROUND OF THE INVENTION

Carrom, billiards, table shuffleboard, and bowling are popular indoor games of skill in which a player rolls or slides a game piece across a playing surface toward other game pieces with which it interacts through collisions. The motion of the game pieces is largely along straight lines, but skilled players may add spin to the moving game pieces in order to alter their trajectory.

The game of curling is played on a large area of specialized ice with large and specialized game equipment. Spinning of the game piece by the releasing player in curling causes it to follow a curved trajectory. The curvature of the game piece trajectory adds an additional element of control and excitement to the game, and is generally pleasing to watch. Curling is also a team game in which an additional player, or players, may help direct the game piece after it has been released by the releasing player.

2 OBJECTS AND ADVANTAGES

Games of skill and entertainment are generally in demand. However, their popularity may be limited by access to game playing surfaces, specialized equipment, and the difficulty of learning the required skills. It is an object of this invention to create a game with moving and physically colliding game pieces which may be played on a table.

Other objects and advantages of the invention will in part be apparent from the specification and drawings.

3 SUMMARY OF THE INVENTION

The following describes a table game construction and method of play in which a game piece follows along a curved trajectory, which may be further directed after release, and which interacts with other game pieces through collisions. The game components include a game board, one or more propelled spinning game pieces, and an optional striking object. The game may be played by a single players alone or against each other, or on teams.

4 BRIEF DESCRIPTION OF THE DRAWINGS

For a more complete understanding of the invention, reference is made to the following description and accompanying drawings, in which.

5 DETAILED DESCRIPTION OF THE EMBODIMENTS

Figure 1:
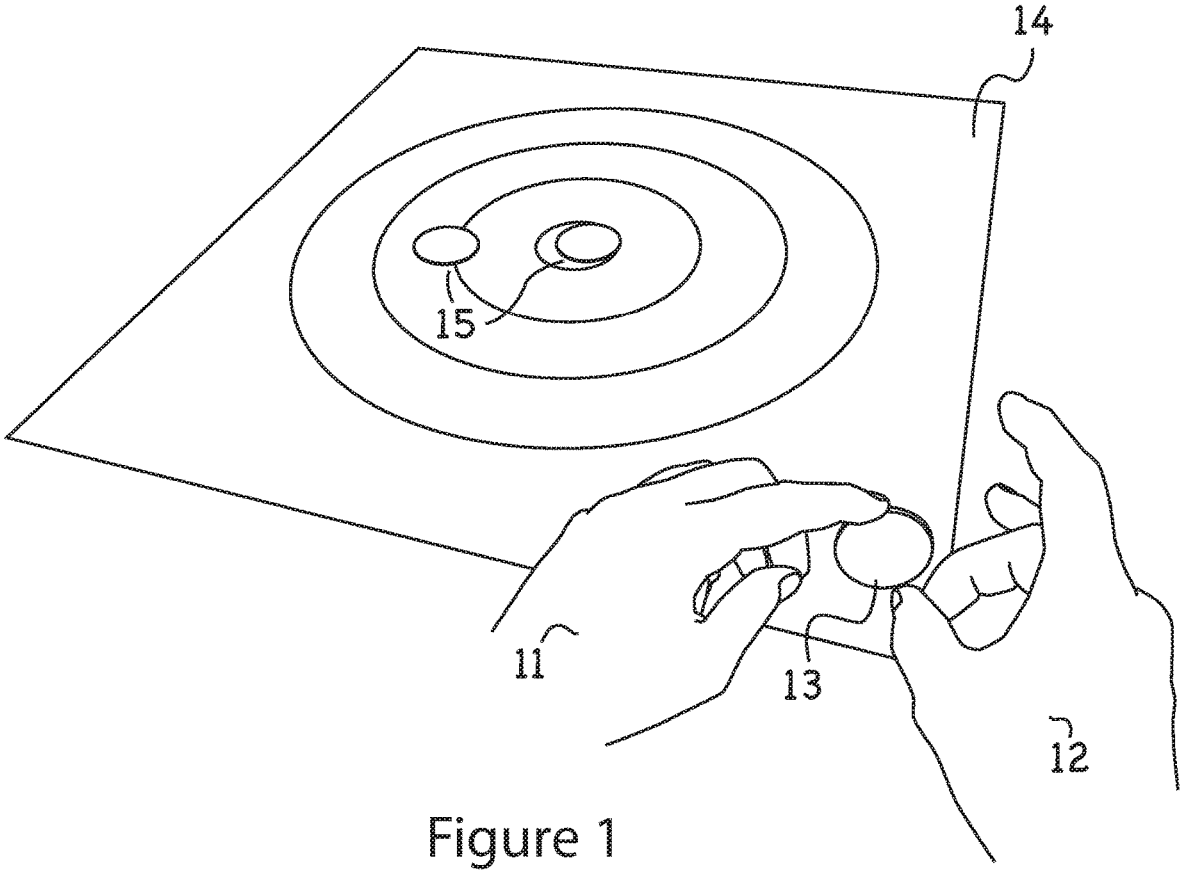
FIG. 1 is a perspective view of a player preparing to play a game piece by flicking it onto the game board.

The arrangement in FIG. 1, shows an exemplary arrangement of the first embodiment. Player one is preparing to play with a holding hand [11] holding a game piece [13], and a flicking hand [12] prepared to set the game piece [13] in motion. There are two resting game pieces [15] near the center of the game board [14].

Figure 3:
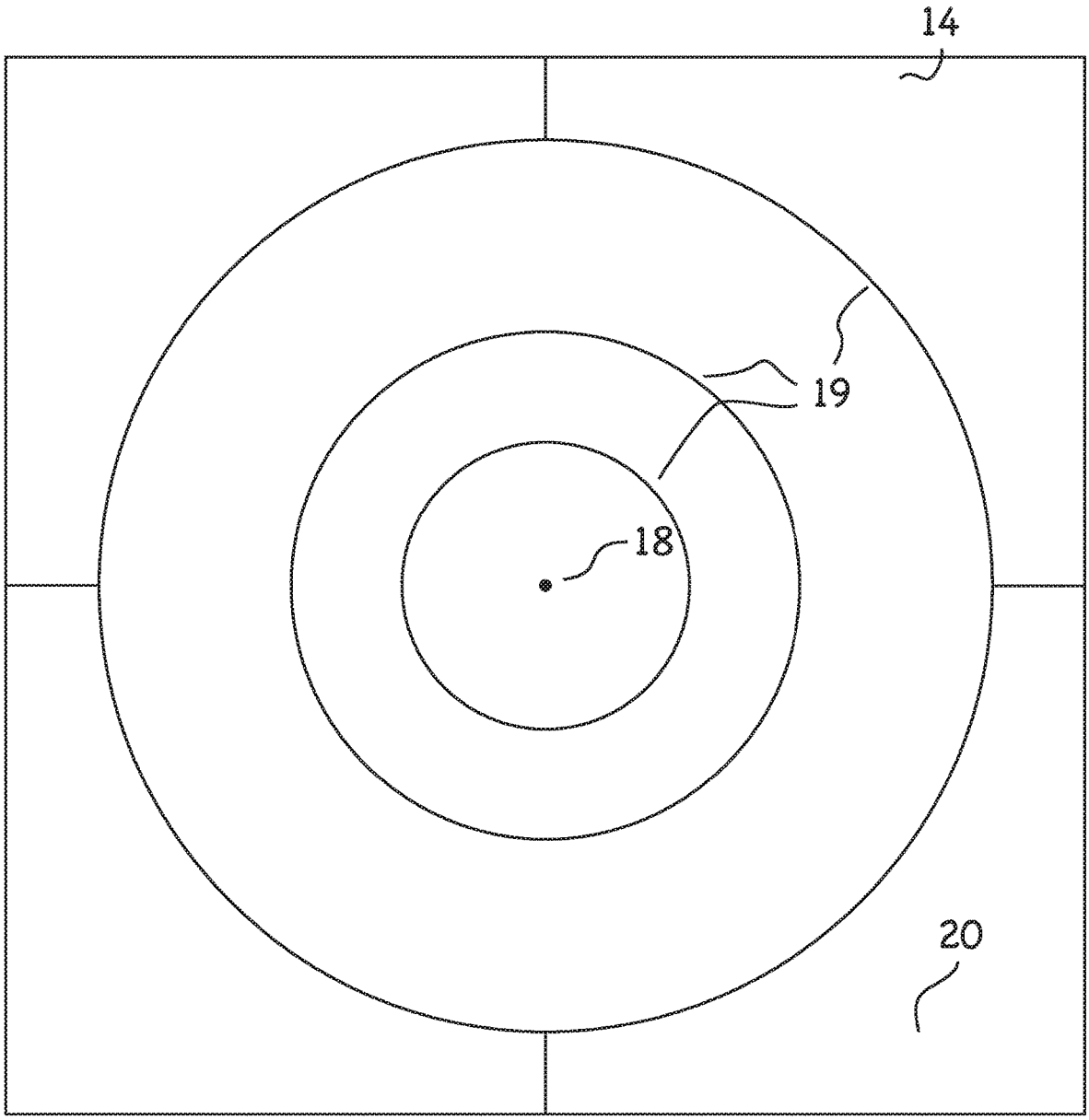
FIG. 3 is a top view of a game board with a center target point and concentric circles.

In the first embodiment, the game is played with two players, each with four disk-shaped game pieces [13, 15] on a planar and level playing surface of the game board [14] which is marked with various printed game board elements. In FIG. 3 the printed game board elements [18, 19, 20] are visible. The target point [18] is at the center of the game board [14] and is surrounded by concentric circles [19]. The concentric circles [19] aid in comparing the distance to the target point [18]. A starting area [20] is also marked. In the first embodiment, the game pieces [13, 15] are disk-shaped of 40 mm diameter and 3 mm thick, and are made of plastic.

Figure 5:
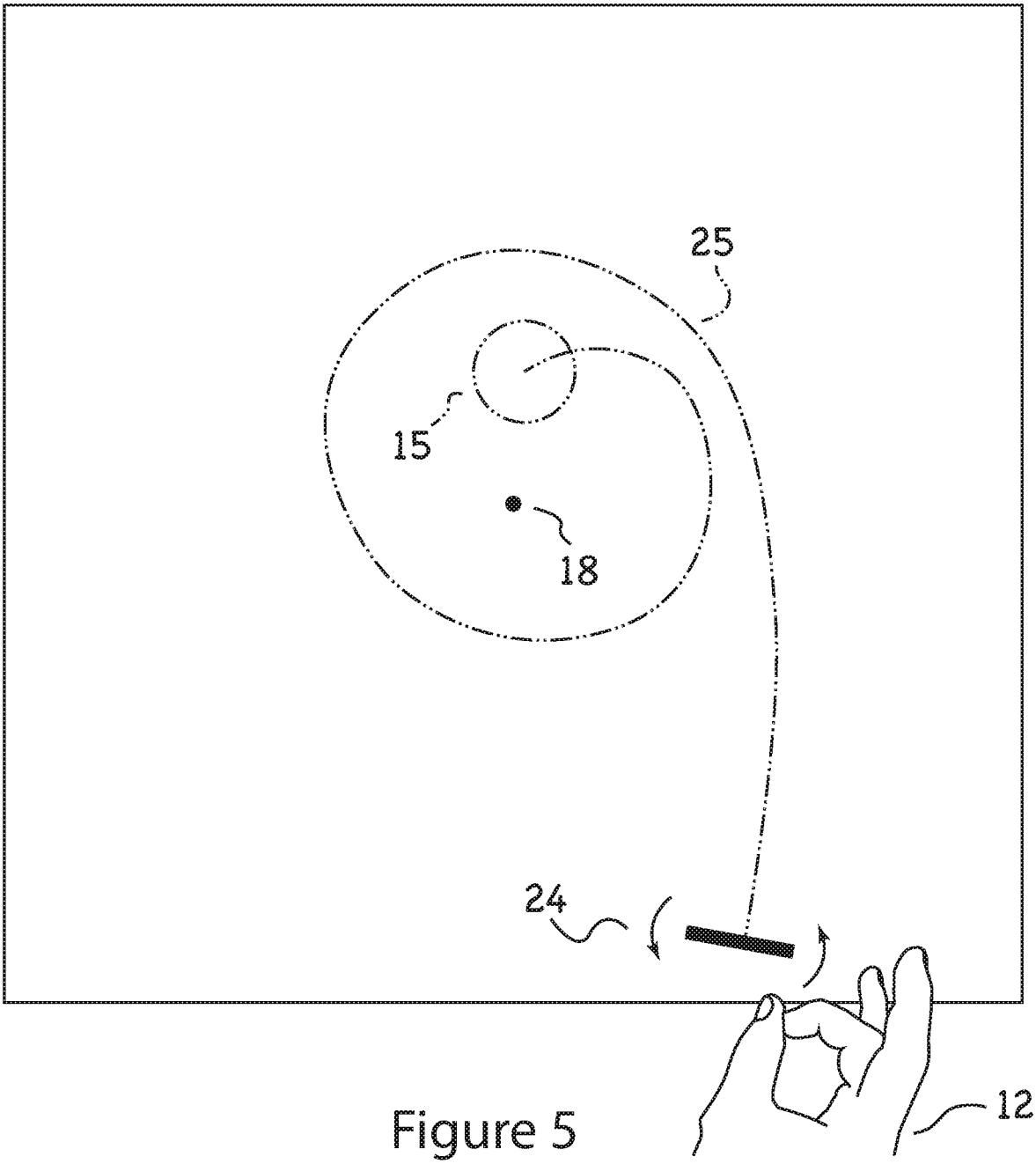
FIG. 5 is a top view of a game board showing the action of flicking the game piece, and tracing the curved trajectory which the game piece will follow until it comes to rest.
Figure 6:
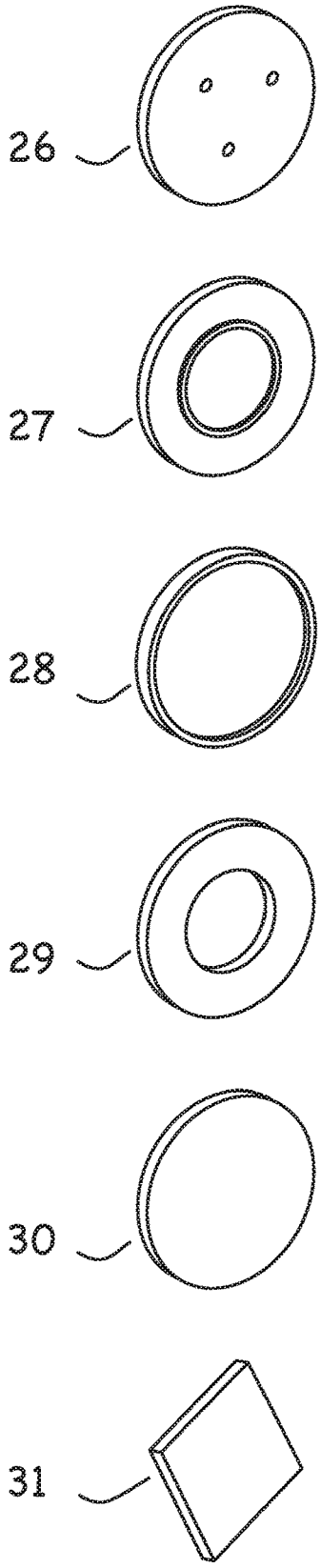
FIG. 6 shows multiple perspective views of variations of game piece constructions.

The object of the game is to get your game pieces [15] to come to rest nearest a target location [18] on the game board [14]. To play the game, player one balances one game piece on edge, holding it up with one finger [11] within the player's starting area [20]. Player one puts the game piece [13] in motion by flicking with a finger of their flicking hand [12]. The game piece is propelled forward and spinning on the playing surface. As depicted in FIG. 5, the spinning game piece tends to trace a curved path [25] in the direction of its rotation [24]. A skilled player may vary their start position, aiming direction, strength of flick, flick contact point, spin rate, game piece orientation, and other variables in order to control the trajectory and resting location of the game piece.

As soon as a game piece [24] is put into motion, it is considered active, and it remains active until it comes to rest on the playing surface [15]. The game piece is left where it comes to rest [15], and it is player two's turn. Player two repeats the procedure with their game piece from their starting area, again leaving their game piece where it comes to rest. Game play continues to alternate until the players have each played all of their game pieces, and the round is over. One point is scored by the player whose resting game piece [15] lies closest to the target point [18]. If the scoring player has more than one game piece closer than the other player's closest game piece, the scoring player scores an additional point for every additional closer game piece. The game pieces are collected, and the next round is begun. Play continues until a specified number of rounds, and the winner is the player with the highest total score.

Figure 2:
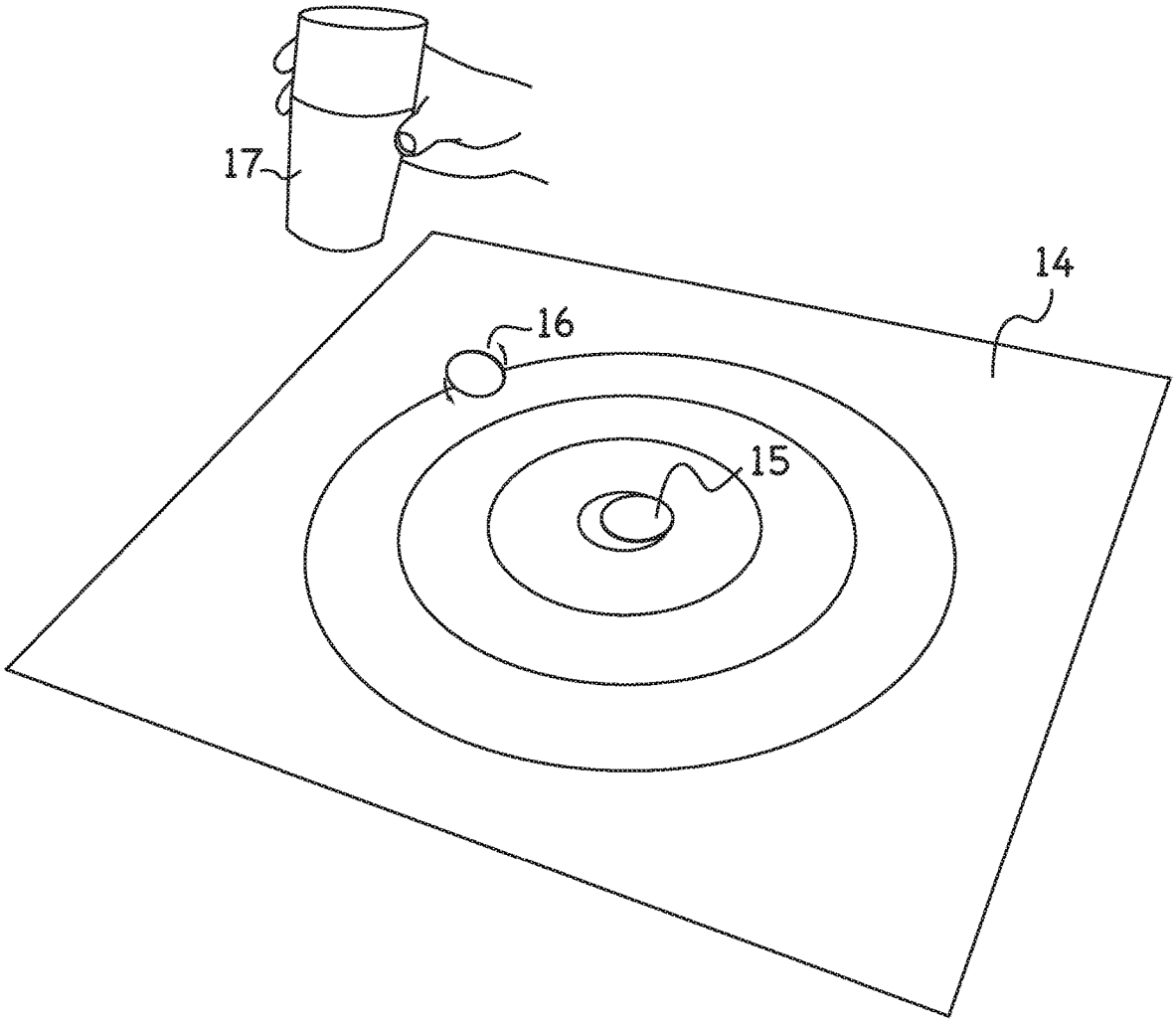
FIG. 2 is a perspective view of a player preparing to strike an active game piece toward a game piece at rest.

In at least one additional embodiment, the shooting player may have the option to strike an active game piece [16] with a striking object [17] before it comes to rest. In FIG. 2, player one has flicked the game piece, and is now holding a striking object [17] and preparing to strike the active game piece [16] with it. The active game piece [16] may be directed by striking toward the target point [18] or in another direction. The active game piece [16] may be directed by striking toward another resting game piece [15] in an attempt to move that game piece toward or away from the target point [18].

In variations of the embodiments previously described, there may be teams. In one or more such variation, when player one flicks the game piece [13], their teammate, player three, may use the striking object [17] to direct the active game piece [16]. In other variations, there may be more than two single players, or more than two teams of multiple players playing on the same board. In other variations, the starting area [20] may be of arbitrary shape, size, and location, and may be the same or different for each player or for each team. In other variations, the starting area [20] is not used, and the game piece [13] may be started at any point, or may only be started off of the board. In other variations, the game piece [13] need not be flicked in order to set it in motion. Instead, any method of spinning may be used including striking with another object or using two hands to spin. Other variations may use an arbitrary number of game pieces. Other variations may keep score in different ways.

5.1 Game Board Construction

The construction of the game board [14] has several effects. If the surface is not level, the active game piece [16] will tend to move toward the lower points. If there are bumps, waviness, curl at the corners, or other imperfections in the flatness of the game board [14], it will also alter the motion of the active game piece [16]. The game board [14] materials as well as surface finish have an impact on the motion as well. This is due to contact friction, energy dissipation, elastic properties, and other factors. These factors will impact time of spin, the tightness of the curve of the active game piece trajectory [25], and the ability of the game pieces to slide after being struck or after a collision.

In one embodiment, the game board [14] is built directly into a table or other rigid surface. It may be printed, painted, dyed, or stained directly onto the surface, it may be constructed of different solid materials or veneers, it may be laminated to the surface, or it may be built into the surface through other means.

Figure 9:
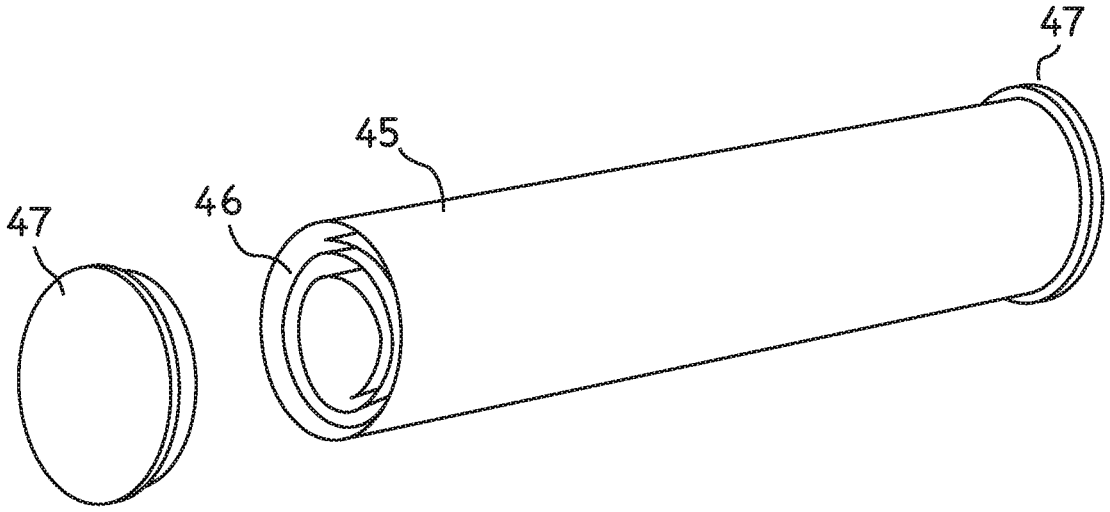
FIG. 9 shows a tube with a rolled game board inside and endcaps.

In at least one other embodiment, the game board [14] is portable, and may be removed from one table, counter, or other support surface to another. Various game board constructions and manufacturing techniques are commonly known in the art. In one or more embodiments, the game board board may be made of any rigid or semi-rigid material, such as plastic, wood, or cardboard. In one or more embodiments, the game board may be folded. In one or more embodiments, the game board has one or more flexible joints at which it can fold. In certain cases, it may be advantageous to be able to roll the game board for transportation. FIG. 9 shows a rolled game board [46] inside a storage tube [45], with two end caps 47. For this and other embodiments, a flexible construction that retains a flat surface after being folded and unfolded or rolled and unrolled may be used.

Figure 8:
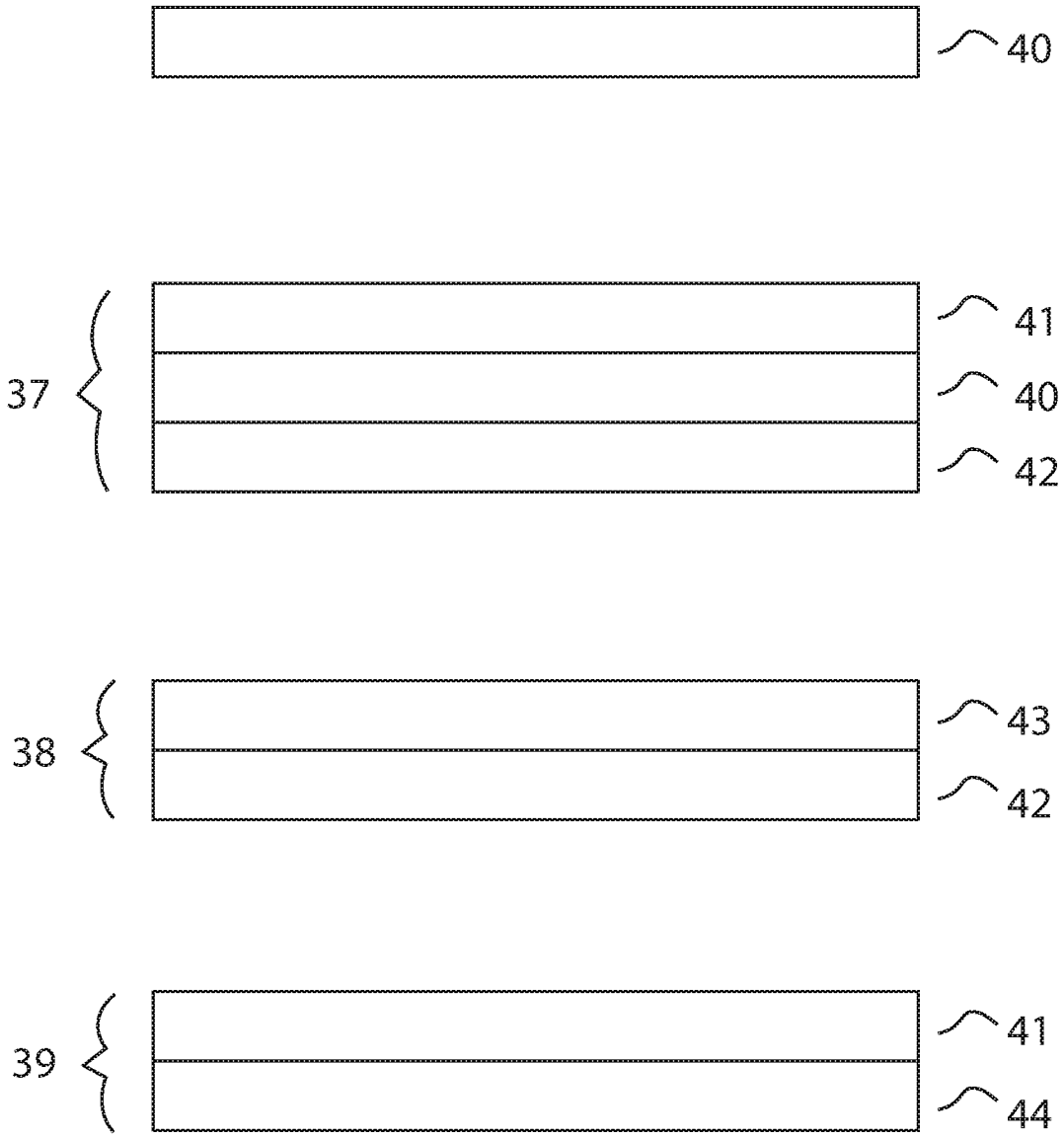
FIG. 8 shows multiple edge views of variations of game board constructions.

In FIG. 8, various game board constructions of flexible materials with one or more layers are depicted from the edge. The top edge of each of these variations is the playing surface, the bottom edge is in contact with a support surface, and the game elements are printed on least one of these layers, which is receptive to printing.

The game board elements may be printed with any type of printing technology including screen printing, lithographic printing, flexographic printing, dye sublimation printing, digital printing, and other types of printing, and they may use any type of ink including conventional solvent, eco-plus, latex, UV, etc. A person skilled in the art will recognize other suitable printing methods.

A single layer board construction embodiment is depicted in FIG. 8. This embodiment has a single printed layer [40] of paper, vinyl banner, plastic, fabric, or any other flexible and printable material. Printing on these materials is commonly known in the art. It may be advantageous for the game board to be resistant to scratches and liquid. UV or latex inks may be may be used in this and other constructions to increase scratch and water resistance.

Additionally, during play, it may be advantageous for the game board [14] to remain stationary and not move. It may tend to do this during play due to game pieces being struck or other motion. An embodiment of a three layer game board construction [37] is illustrated with two additional optional layers: a lamination layer [41], and a grip layer [42]. Both layers may be used, or one may be omitted. The lamination layer [41] serves to increase scratch and water resistance among other effects. Lamination film materials are commonly known in the art, and may be transparent. The lamination layer [41] is flexible and thin, and may be applied through hot lamination, cold lamination, liquid lamination, or other methods.

The grip layer [42] prevents the game board [14] from moving during play. This grip layer [42] may be constructed of a laminated sheet material such as foam, rubber, foamed rubber, other polymers, or other materials which may be laminated through heat lamination, pressure sensitive adhesive, or other adhesive methods. The grip layer [42] may be alternatively applied through spray, roll, or other coating method of a liquid, or may be applied as a hot melt material through spray, placed dots, roll coating, or other methods. The grip layer [42] may be adhesive, and is possibly removable and reusable. In another alternative, the grip layer [42] may be not permanently adhered to the game board, but is a separate sheet which grips on both sides. Examples of this type of material are a silicone baking mat or a non-slip shelf liner, but may be other materials.

A two layer game board construction [38] is illustrated with a printed lamination layer [43] and a grip layer [42]. A two layer game board construction [39] is also illustrated with a lamination layer [41] and a printed grip layer [44]. In these constructions, the printing is applied directly to either the printed lamination layer [43], or the printed grip layer [44], and therefore removes the need for a printed layer [40]. Materials for and methods of printing on the printed lamination layer [43] and the printed grip layer [44] are commonly known. If the entire construction is thin and flexible, it will have lower bending stiffness, and may retain flatness during gameplay.

5.2 Game Piece Construction

Figure 7:
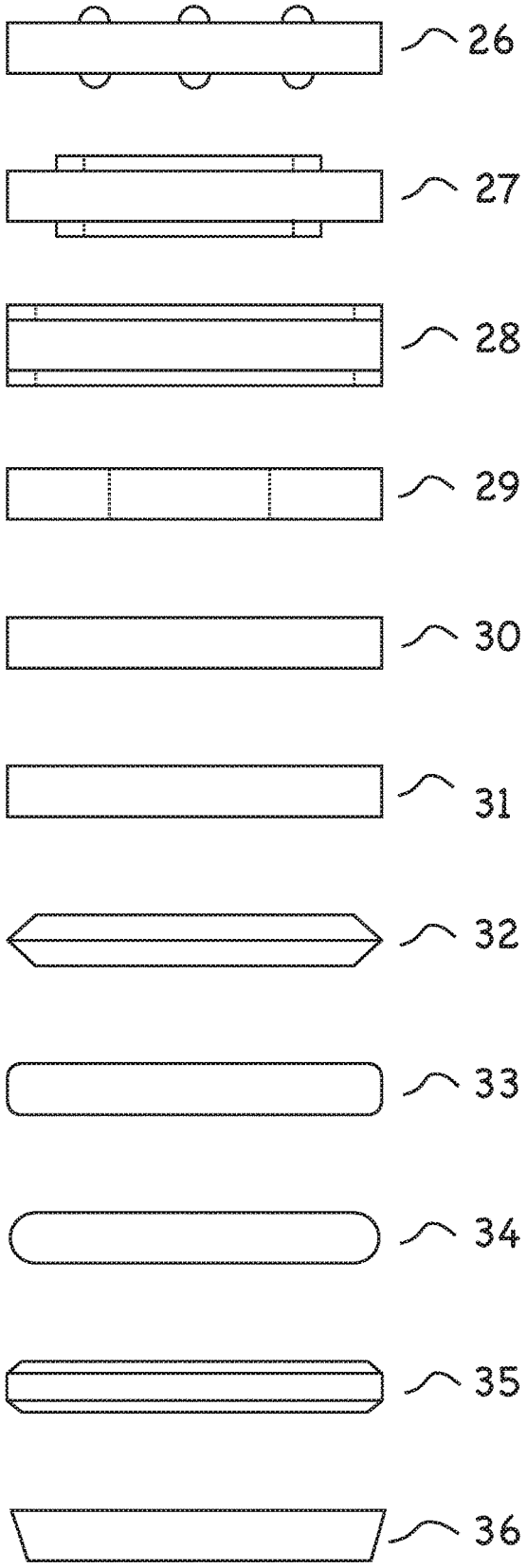
FIG. 7 shows multiple edge views of variations of game piece constructions.

In FIG. 7, various game piece constructions are depicted in perspective, and in FIG. 7 perspective from the edge. The construction of the game pieces has an effect on game play both independent of and in combination with the game board [14]. The game mechanics include sliding contact interaction between the active game piece [16] and the game board. This means that the material, mass, stiffness, and surface finish among other properties of both the active game piece [16] and the game board [14] influence the motion. The relative motion and position between the two including velocity, angular velocity, and orientation may have different effects on the path of the game piece depending on the properties of both the active game piece [16] and the game board [14].

In embodiments in which the active game piece [16] is struck before it comes to rest, it does not lie flat on the playing surface. Because of this, the active game piece [16] can pass over the resting game piece [15], rather than striking it directly and moving it. In addition to making the game piece thicker, alternate constructions including a game piece with raised lip edges [28], a disk game piece with protruding rings [27], and disk game piece with protruding dots [26] among others may raise the contact edge and decrease the likelihood of this happening.

In addition to raising the contact edge, a game piece with raised lip edges [28], a disk game piece with protruding rings [27], and a disk game piece with protruding dots [26] each have reduced contact area when laying flat which may be advantageous for reducing friction and sticking to the game board. The game piece with center hole [29] has reduced contact area when laying flat, and additionally has a lower mass to rotational moment of inertia ratio than a disk shape, which may affect game play.

The width and the shape of the edge of the game piece has an effect on the trajectory it takes. The game piece with right angle edges [30], the game piece with triangular edges [32], the game piece with filleted edges [33], the game piece with round edges [34], the game piece with chamfered edges [35], and the game piece with asymmetric edges [36] are all variations of the edge shape of the game piece. A very rounded edge [34] or pointed edge [32] have been observed to curve very little. A very wide edge such as [28] has been observed to curve less and remain upright longer. A game piece with filleted edges [33] has been observed to follow broad, smooth curves. A right angle edge such as [30] has been observed to go straight initially and take a sharp turn.

In one or more embodiments, the game pieces are substantially disk shaped of arbitrary size. Alternatively, the game piece may be of arbitrary size or shape, such as a square game piece [31]. In one or more embodiments, the game pieces are made of a plastic material. Alternatively they may be made of ceramic, metal, paper, cardboard, a composite material, or other rigid material.

Many other variations of the game piece construction such as polishing or adding texture to the edges and/or sides, adding a surface coating to the edges and/or sides, or constructing the edges of a different material than the body. All of these variations are known to impact the active game piece trajectory [25], and/or the sliding friction of a game piece lying flat and may impact game play.

5.3 Other Variations

Figure 4:
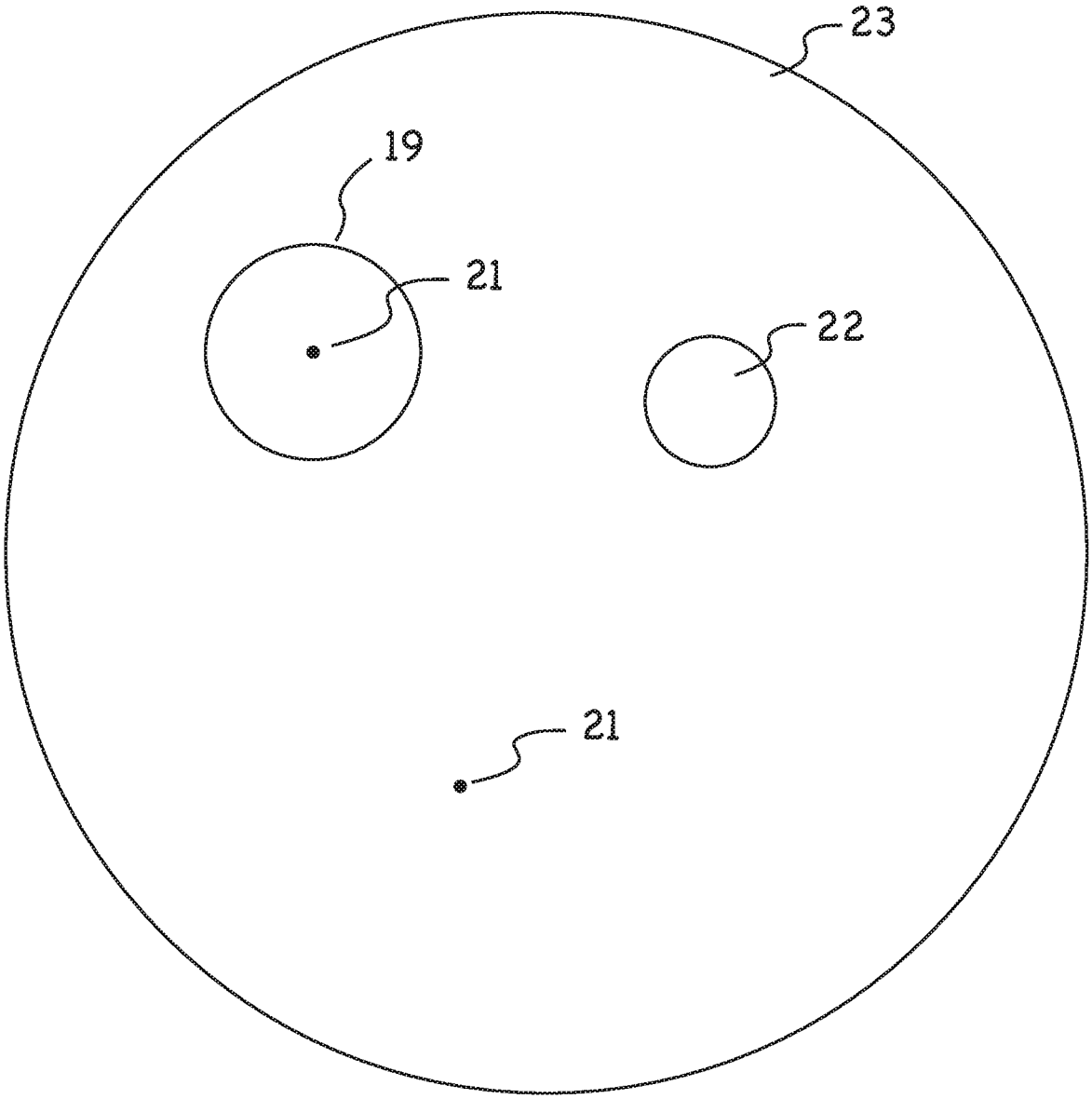
FIG. 4 is a top view of a game board with multiple target points and one target area.

As illustrated in FIG. 4, the markings on the game board may be of arbitrary location, shape, and size, and the game board may be circular [circular game board [23]] or of arbitrary shape. There may be one or more target point [21] or one or more target area [22]. A target area [22] is different from a target point [21] in that the purpose is to get a game piece to lie within or touching a target area [22], rather than simply being nearest to a target point [21].

In at least one variation, different construction game pieces may be used in the same game. In at least one variation, the last game piece to play is of a different construction than the rest. In one or more embodiments, the sides of the game pieces are marked with symbols, images, or text, which may or may not influence the game play physically or through the markings having an impact on the game scoring or other rules. In one or more embodiments, additional playing pieces may be placed on the game board [14] which serve as obstacles. These additional playing pieces may be the same shape and size as the game pieces or of different arbitrary shape and size.

In at least one embodiment, the playing surface of the game board [14] is textured. In at least one embodiment, an additional substance is added to the playing surface such as wax, teflon, a lubricant, a tackifier, or other substance. In one or more embodiments, the playing surface is purposefully not planar such that it alters the active game piece trajectory [25] similar to a green in golf. In one or more embodiments, the playing surface has areas of different frictional properties. In one or more embodiments, the game board markings are not permanent, and may be moved. In at least one variation, there may be more than one target point or target area. In at least one variation, the more than one target point or area may be worth different points. In at least one variation, the more than one target point or area may trigger different game rules to come into effect.

In at least one embodiment, the table game is stored in a tube with closed ends as shown in the exemplary FIG. 9. In at least one embodiment the closed ends are removable end caps [47]. In at least one embodiment, the removable end caps [47], or the storage tube [45] may be used as the striking object [17]. In other variations, the striking object may be of arbitrary shape and size. It may be for example in the shape of a hockey stick, an air hockey paddle, a cup, etc. In other variations, the active game piece [16] may be further directed through blowing, tilting the game board, touching with one's body, or through other means. In at least one embodiment the game piece [13] may be put into motion with a spring loaded or otherwise energized flicking apparatus.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. A method of playing a table game comprising: providing a table game that includes a game board, wherein the game board is flexible such that it may be rolled and it retains a flat surface after being unrolled, wherein the game board comprises a grip layer which prevents the game board from moving during play, and a lamination layer which provides scratch and water resistance, wherein the game board contains at least one target location, a plurality of striking objects, a plurality of game pieces; propelling a game piece on its edge such that it spins and traces a curved path on the game board; directing the propelled game piece by striking it one time only with a striking object after it has been propelled and before it comes to rest; scoring points for bringing the propelled game piece to rest near the at least one target location.

2. A method of playing a table game according to claim 1 in which the propelled game piece interacts with other game pieces through collisions after it has been propelled and before it comes to rest.

3. A method of playing a table game according to claim 1 in which one team member propels the propelled game piece, and a different team member further directs the propelled game piece by striking it one time only with a striking object after it has been propelled and before it comes to rest.

4. A method of playing a table game according to claim 1 in which the game pieces are disk shaped.

5. A method of playing a table game according to claim 3 in which the game pieces contain additional features chosen from dots, rings, lips, angled edges, round edges, filleted edges, chamfered edges.

6. A method of playing a table game according to claim 1 in which the game pieces are ring shaped.

7. A method of playing a table game according to claim 1 in which the table game additionally includes a carrying case comprising a tube and at least one end cap, in which the at least one end cap is used as a striking object.

8. A method of playing a table game according to claim 1 in which the grip layer comprises a rubber material.

9. A method of playing a table game according to claim 1 in which the lamination layer comprises a thin transparent plastic material.

* * * * *